US011077465B2

(12) United States Patent
Fedders

(10) Patent No.: US 11,077,465 B2
(45) Date of Patent: Aug. 3, 2021

(54) SCREEN ASSEMBLY FOR A VIBRATORY SEPARATOR

(71) Applicant: M-I L.L.C., Houston, TX (US)

(72) Inventor: John Fedders, Union, KY (US)

(73) Assignee: Schlumberger Technology Corporation, Sugar Land, TX (US)

( * ) Notice: Subject to any disclaimer, the term of this patent is extended or adjusted under 35 U.S.C. 154(b) by 215 days.

(21) Appl. No.: 16/455,683

(22) Filed: Jun. 27, 2019

(65) Prior Publication Data

US 2020/0406300 A1 Dec. 31, 2020

(51) Int. Cl.
*B07B 1/46* (2006.01)
*B07B 1/36* (2006.01)

(52) U.S. Cl.
CPC ..... *B07B 1/4609* (2013.01); *B07B 1/36* (2013.01); *B07B 2201/02* (2013.01); *B07B 2201/04* (2013.01)

(58) Field of Classification Search
CPC ..... B07B 1/36; B07B 1/4609; B07B 2201/02; B07B 2201/04
USPC ..... 209/319
See application file for complete search history.

(56) References Cited

U.S. PATENT DOCUMENTS 5,615,776 A * 4/1997 Bjorklund ..... B07B 1/4645 209/403
6,698,593 B1 3/2004 Folke et al.
8,561,804 B2 * 10/2013 Carr ..... B07B 1/46 209/405
2009/0294335 A1 12/2009 Roppo et al.
2010/0236995 A1 * 9/2010 Carr ..... E21B 21/065 209/365.1
2011/0036759 A1 2/2011 Ballman
2014/0124417 A1 5/2014 Holton
2018/0179837 A1 6/2018 Holton et al.

OTHER PUBLICATIONS

International Search Report and Written Opinion issued in International Patent application PCT/US2020/038306 dated Oct. 5, 2020, 9 pages.

* cited by examiner

*Primary Examiner* — Terrell H Matthews
(74) *Attorney, Agent, or Firm* — Jeffrey D. Frantz

(57) ABSTRACT

Systems and methods for a screen assembly configurable in a multi-screen configuration. The screen assembly in the multi-screen configuration includes a lower shaker screen and an upper shaker screen. A track is configured to be disposed on an inside wall of a vibratory separator and includes an upper retainer and a lower retainer. A screen clamping assembly is disposed in the track and includes a small spacer disposed between the lower shaker screen and the upper shaker screen in the track when the screen assembly is in the multi-screen configuration. An actuator is disposed in the track and has a clamped position where the actuator is actuated to provide a clamping force to clamp the lower shaker screen, the upper shaker screen, and the small spacer between the upper retainer and the lower retainer of the track.

20 Claims, 14 Drawing Sheets

SCREEN ASSEMBLY FOR A VIBRATORY SEPARATOR

BACKGROUND

Many applications call for filtering screens be secured to a machine, whether temporarily or permanently. Some examples of this include water treatment applications, hazardous material handling applications, and drilling applications. For example, in oilfield environments, fluid used in oilfield activities are generally filtered via a screening process. Failure to keep solids out of the drilling fluid could mean diminished rate of penetration, equipment damage, non-productive time, and higher costs. Further, efficient screening reduces the time required to filter the fluid.

One mechanism for separating the contaminants and/or undesirable objects from drilling fluid is the use of screen assemblies in vibratory separators (e.g., shale shakers). The screen assemblies include at least one shaker screen to filter contaminants and/or undesirable objects from the drilling fluid as the vibratory separator vibrates. The screen assemblies may include a screen clamping assembly to clamp at least one screen in a vibratory separator. Depending on the application, different screen configurations may be needed to filter the drilling fluid. For example, some screen configurations may have a single screen and other screen configurations may have multiple screens. In addition, the screen configurations may include a screen configuration with a shaker screen at one level and another screen configuration with a shaker screen at a first level and another shaker screen at a second level. Providing vibratory separators having different screen configurations for different applications can increase the time for filtering the drilling fluid. There exists a need to more efficiently provide different screen configurations for filtering drilling fluid with vibratory separators.

SUMMARY

This summary is provided to introduce a selection of concepts that are further described below in the detailed description. However, many modifications are possible without materially departing from the teachings of this disclosure. Accordingly, such modifications are intended to be included within the scope of this disclosure as defined in the claims. This summary is not intended to identify key or essential features of the claimed subject matter, nor is it intended to be used as an aid in limited the scope of the claimed subject matter.

In one embodiment, a screen assembly includes a lower shaker screen and an upper shaker screen. The screen assembly is configurable in a multi-screen configuration including the lower shaker screen and the upper shaker screen. A track is configured to be disposed on an inside wall of a vibratory separator and includes an upper retainer and a lower retainer. A screen clamping assembly is disposed in the track. The screen clamping assembly includes a small spacer having a first spacer dimension selected to correspond to the multi-screen configuration. The small spacer is disposed between the lower shaker screen and the upper shaker screen in the track to space the lower shaker screen at a lower level and the upper shaker screen at an upper level in the track when the screen assembly is in the multi-screen configuration. The screen clamping assembly further includes an actuator disposed in the track. The screen clamping assembly has a clamped position where the actuator is actuated to provide a clamping force to clamp the lower shaker screen, the upper shaker screen, and the small spacer between the upper retainer and the lower retainer of the track.

In another embodiment, a method for installing a screen assembly of a vibratory separator is provided. The method includes installing the screen assembly in a multi-screen configuration where the screen assembly has a lower shaker screen, an upper shaker screen, a track, and an actuator disposed in the track. Installing the screen assembly in the multi-screen configuration includes inserting in the track the lower shaker screen at a lower level, inserting in the track above the lower shaker screen a small spacer having a first spacer dimension selected to correspond to the multi-screen configuration, and inserting in the track above the small spacer the upper shaker screen at an upper level. Installing the screen assembly in the multi-screen configuration further includes actuating the actuator disposed in the track to provide a clamping force to clamp the small spacer, lower shaker screen, and the upper shaker screen inserted in the track between an upper retainer and a lower retainer of the track in a clamped position of the multi-screen configuration.

In another embodiment, a method for configuring a screen assembly on a vibratory separator between a multi-screen configuration and a single screen configuration is provided. The method includes installing the screen assembly in a multi-screen configuration where the screen assembly has a lower shaker screen, an upper shaker screen, a track, and an actuator disposed in the track. Installing the screen assembly in the multi-screen configuration includes inserting in the track the lower shaker screen at a lower level, inserting in the track above the lower shaker screen a small spacer having a first spacer dimension selected to correspond to the multi-screen configuration, and inserting in the track above the small spacer the upper shaker screen at an upper level. Installing the screen assembly in the multi-screen configuration further includes actuating the actuator disposed in the track to provide a clamping force to clamp the small spacer, lower shaker screen, and the upper shaker inserted in the track between an upper retainer and a lower retainer of the track in a clamped position of the multi-screen configuration. The method further includes installing the screen assembly in a single screen configuration including when the screen assembly is in the multi-screen configuration, removing the upper shaker screen and the small spacer from the track. The method of installing the screen assembly in a single screen configuration further including after removing the upper shaker screen and the small spacer from the track, inserting in the track above the lower shaker screen and adjacent the actuator a large spacer having a second spacer dimension larger than the first spacer dimension of the small spacer and selected to correspond to the single screen configuration. The method of installing the screen assembly in a single screen configuration further including actuating the actuator to provide a clamping force to clamp the large spacer and the first shaker screen between the upper retainer and the lower retainer of the track in a clamped position of the single screen configuration.

BRIEF DESCRIPTION OF THE FIGURES

Certain embodiments of the disclosure will hereafter be described with reference to the accompanying drawings, wherein like reference numerals denote like elements. It is emphasized that, in accordance with standard practice in the industry, various features are not drawn to scale. In fact, the dimensions of various features may be arbitrarily increased or reduced for clarity of discussion. It should be understood, however, that the accompanying figures illustrate the various implementations described herein and are not meant to limit the scope of various technologies described herein, and.

DETAILED DESCRIPTION

Figure 1:
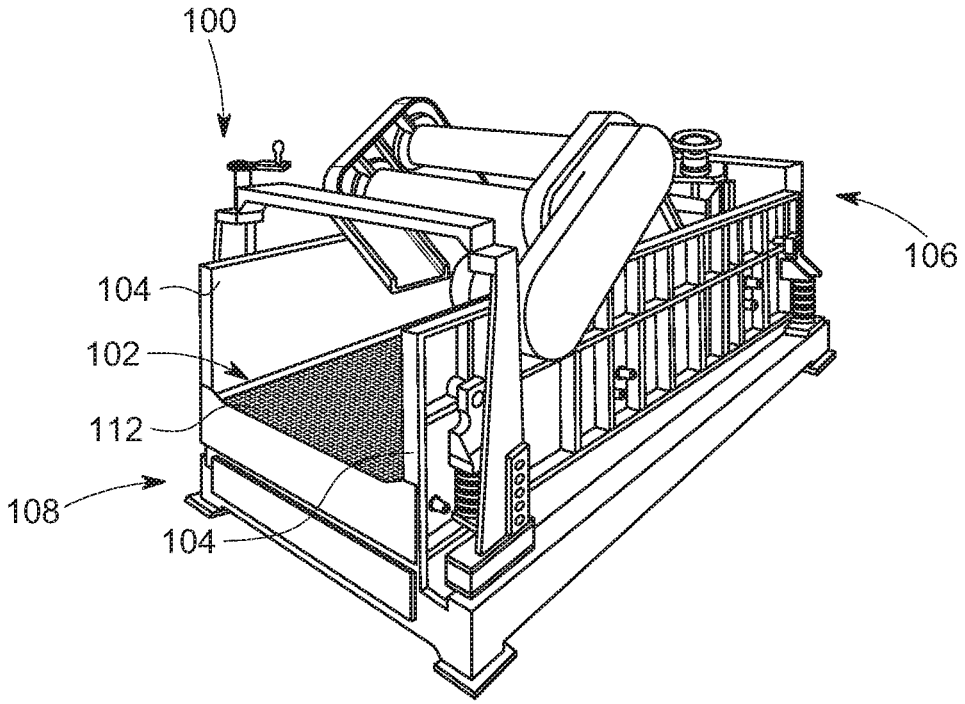
FIG. 1 shows a perspective view of an example vibratory separator.

In the following description, numerous details are set forth to provide an understanding of some embodiments of the present disclosure. It is to be understood that the following disclosure provides many different embodiments, or examples, for implementing different features of various embodiments. Specific examples of components and arrangements are described below to simplify the disclosure. These are, of course, merely examples and are not intended to be limiting. In addition, the disclosure may repeat reference numerals and/or letters in the various examples. This repetition is for the purpose of simplicity and clarity and does not in itself dictate a relationship between the various embodiments and/or configurations discussed. However, it will be understood by those of ordinary skill in the art that the system and/or methodology may be practiced without these details and that numerous variations or modifications from the described embodiments are possible. This description is not to be taken in a limiting sense, but rather made merely for the purpose of describing general principles of the implementations. The scope of the described implementations should be ascertained with reference to the issued claims. As used herein, the terms "upper" and "lower" and other like terms indicating relative positions to a given point or element are utilized to more clearly describe some elements.

The disclosure generally relates to screen assemblies for vibratory separators. Specifically, the disclosed systems, devices, apparatus, and/or methods relate to screen assemblies for improved installation of one or more screens in different configurations.

FIG. 1 depicts an example vibratory separator 100. Vibratory separator 100 may be a vibratory shaker used in the oilfield industry to process wellbore fluids. Vibratory separator 100 includes at least one screen assembly 102, a pair of inner walls 104, a feed end 106, and a discharge end 108. The screen assembly 102 is disposed on the inside walls 104 and may include one or more shaker screens 112. Drilling fluid, along with drill cuttings and debris, may be deposited on top of the shaker screen 112 at the feed end 106. The screen assembly 102 may be vibrated (e.g., 25-40 Hz frequency range) by a motor or motors for the purpose of screening or separating the drilling fluid on screen assembly 102. The liquid and fine particles of the drilling fluid may pass through the screen assembly 102 by force of gravity and acceleration caused by the motor and may be recovered underneath the screen assembly 102. Solid particles greater than a certain size may migrate and vibrate across the screen assembly 102 where they may be discharged at the discharge end 108. The screen assembly 102 may include filtering elements, such as mesh, attached to a screen frame. The filtering elements may further define the largest solid particle capable of passing therethrough.

Figure 2A:
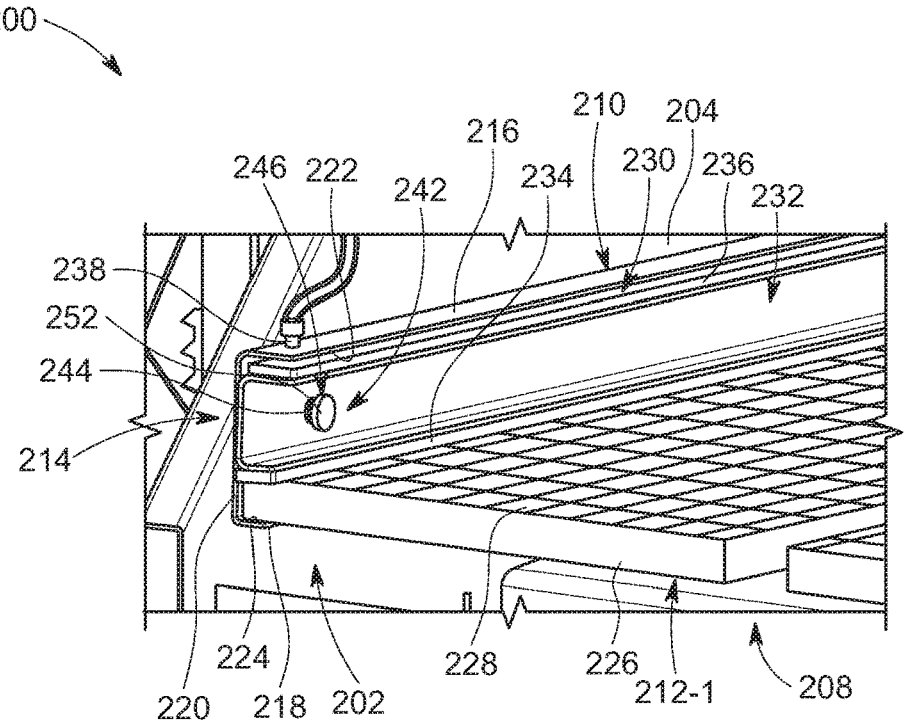
FIG. 2A shows a perspective partial view of an embodiment of a screen assembly installed in the vibratory separator in a single screen configuration of the present disclosure.

FIG. 2A shows a partial view of a screen assembly 202 installed in a vibratory separator 200 in a single screen configuration, in accordance with at least one embodiment of the present disclosure. FIG. 2A shows a view from a discharge end 208 of a left section of the vibratory separator 200. The screen assembly 202 includes a pair of tracks 210, lower shaker screen 212-1, also referred to as a first shaker screen, and a pair of screen clamping assemblies 214. Screen assembly 202 is shown disposed on one of the opposing inner walls 204 of the vibratory separator 200. The inner walls 204 may form part of a basket of the vibratory separator 200. The pair of tracks 210 oppose one another on opposite inner walls 204 of the vibratory separator 200. FIG. 2A shows the track 210 disposed on the inner wall 204 of the left section of the vibratory separator 200 and another track 210 is disposed on the inner wall 204 of the right section of the vibratory separator 200, as shown in FIG. 2A. Lower shaker screen 212-1 includes a screen frame 226 and a filtering media 228 attached to the screen frame 226.

Track 210 includes an upper retainer 216, a lower retainer 218, and a fixture wall 220 extending between the upper retainer 216 and lower retainer 218. Both the upper retainer 216 and the lower retainer 218 extend from the fixture wall 220 and the inner wall 204. The track 210 has a "U" shape and has a track channel that runs the length of track 210. Track 210 is secured to the inner wall 204 by welding track 210 to the inner wall 204 or using one or more attachment devices, for example mechanical fasteners such as screws and bolts or other conventional attachment devices. The upper retainer 216 includes a bottom surface 222 and the lower retainer 218 includes a top surface 224.

Screen clamping assembly 214 includes an actuator 230, a large spacer 232, and a seal 234 disposed in the track 210 between the upper retainer 216 and the lower retainer 218. The actuator 230 is disposed adjacent to the bottom surface 222 of the upper retainer 216 in the embodiment shown in FIG. 2A.

In the embodiment shown, actuator 230 may be a bladder 236 having a nozzle 238. Bladder 236 may be actuated by inflating the bladder 236 and may be de-actuated by deflating the bladder 236. A fluid media such as air, water, or any similar item is pumped into the bladder 236 via nozzle 238 causing the bladder 236 to expand and press down on the large spacer 232, seal 234, and lower shaker screen 212-1 to clamp and secure the lower shaker screen 212-1 at a lower level in the track 210 of screen assembly 202 to form a lower deck. When inflated, the bladder 236 may clamp and secure the lower shaker screen 212-1 in a clamped position. Because the bladder 236 is restrained by the upper retainer 216, the bladder's expansion forces the bladder 236 downward onto the large spacer 232. The force on the large spacer 232 from the bladder 236 is transferred to the lower shaker screen 212-1. In this manner, the screen 212-1 is clamped and/or pinned in place between the upper retainer 216 and the lower retainer 218. This restricts movement of the lower shaker screen 212-1 along the length of the track 210. When deflated, the bladder 236 releases the downward force against the large spacer 232 and lower shaker screen 212-1, and the lower shaker screen 212-1 is in an unclamped position. In some embodiments, the actuator 230 may be a mechanical clamp or mechanical wedge.

Seal 234 is disposed between the large spacer 232 and the lower shaker screen 212-1. Seal 234 is a separate component in the embodiment shown FIG. 2. In other embodiments, the seal 234 may be attached to the large spacer 232 or lower shaker screen 212-1. In other embodiments, the seal 234 may be removed from the single screen configuration. The seal 234 is configured to extend along the length of the large spacer 232 and abuts against a bottom surface of the large spacer 232 and a top surface of the screen frame 226.

Screen assembly 202 further includes a spacer retainer assembly 242. The spacer retainer assembly 242 may secure the large spacer 232 in place when the actuator 230 is de-actuated. Spacer retainer assembly 242 includes a spacer retainer 246 and a spacer keyway 244, also referred to as a spacer slot, in the large spacer 232. The spacer retainer 246 has an elongated section and a head section 252 sized for the spacer keyway 244. The elongated section of the spacer retainer 246 extends through the spacer keyway 244. The elongated section of the spacer retainer 246 may extend into the fixture wall 220 of track 210 to secure spacer retainer 246 to the track 210 and inner wall 204 of the vibratory shaker 200. In some embodiments, spacer retainer 246 is mechanically attached to the track 210 and/or inner wall 204, for example by a press fit or screw threads on the spacer retainer 246 that screw into mating screw threads in the track 210 and/or inner wall 204. The spacer retainer 246 may be welded to the track 210 and/or the inner wall 204 of the vibratory separator 200 or the spacer retainer 246 may be screwed into a weld nut or threaded insert connected to the track 210 or inner wall 204. Welding the spacer retainer 246 provides a more permanent installation of the spacer retainer 246. A threaded installation of the spacer retainer 246 allows for removal of the spacer retainer 246 in case of damage and replaced with a spacer retainer 246 that is undamaged. The head section 252 of the spacer retainer 246 is sized to be larger than the spacer keyway 244 so as to abut against an inner surface of the large spacer 232 when the elongated section of the spacer retainer 246 is inserted in the spacer keyway 244 so as to secure the large spacer 232 in the track 210. In some embodiments, there may be multiple spacer retainer assemblies 342 spaced apart from one another along the length of the tracks 210 and the large spacers 232 to allow the large spacers 232 or small spacers 233 to be installed and supported in the tracks 210.

FIG. 2A shows the spacer retainer assembly 242 in a spacer retained position where the large spacer 232 is secured in place in the track 210 by the spacer retainer assembly 242. Spacer retainer 246 may be removed from the large spacer 232 to position the spacer retainer assembly 242 in a spacer unretained position where the large spacer 232 is not secured in place within the track 210 by the spacer retainer assembly 242. The large spacer 232 may be removed from the track 210 by sliding the large spacer 232 from the track 210 after the spacer retainer 246 has been removed.

Figure 2B:
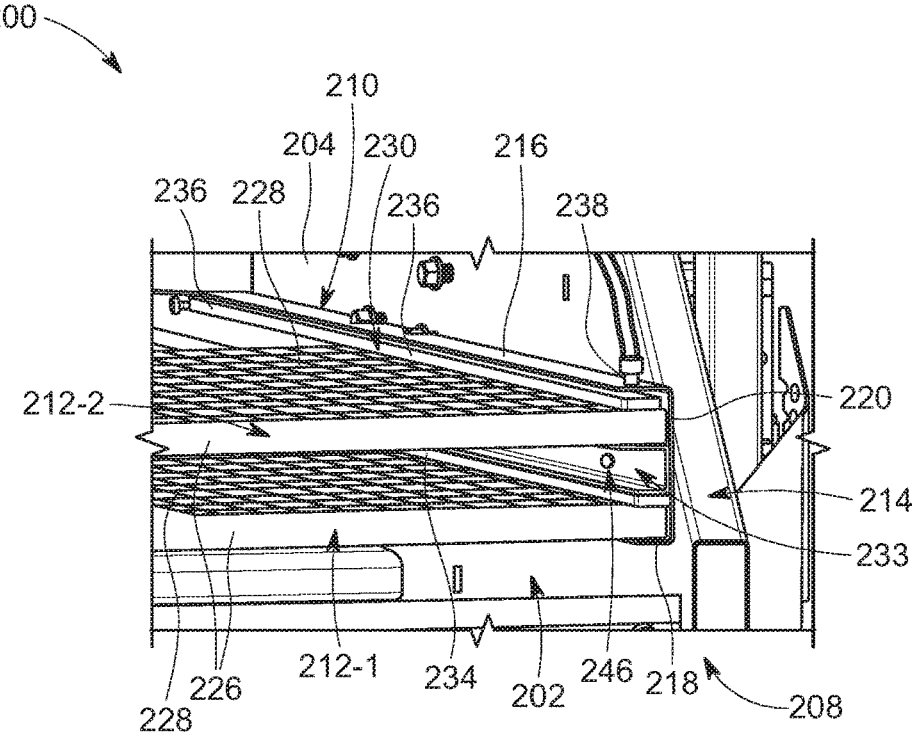
FIG. 2B shows a perspective partial view of an embodiment of the screen assembly installed in the vibratory separator in a multi-screen configuration of the present disclosure.

FIG. 2B shows a partial view of the screen assembly 202 installed in the vibratory separator 200 in a multi-screen configuration, in accordance with at least one embodiment of the present disclosure. FIG. 2B shows a view from a discharge end 208 of a right section of the vibratory separator 200. The screen assembly 202 includes the pair of tracks 210, the lower shaker screen 212-1, an upper shaker screen 212-2, and the screen clamping assembly 214. Screen assembly 202 is shown disposed on one of the opposing inner walls 204 of the vibratory separator 200. Lower shaker screen 212-1 may be the same lower shaker screen 212-1 used in the single screen configuration. In other embodiments, the lower shaker screen 212-1 may be another shaker screen 212.

When in the multi-screen configuration, screen clamping assembly 214 includes the actuator 230, a small spacer 233, and a seal 234 disposed in the track 210 between the upper retainer 216 and the lower retainer 218. Large spacer 232 is not used in the screen clamping assembly 214 when the screen clamping assembly 214 is in the multi-screen configuration. Large spacer 232 has been replaced by the small spacer 233 for the multi-screen configuration.

Small spacer 233 is configured to have a first spacer dimension selected to correspond to the multi-screen configuration. Small spacer 233 is selected to have the first spacer dimension to accommodate at least the lower shaker screen 212-1, small spacer 233, and upper shaker screen 212-2 in the track 210. The first spacer dimension may be the height of the small spacer 233 when positioned in the track 210 between the lower shaker screen 212-1 and 212-2. In some embodiments, the height of the small spacer 233 may range from 2 inches (5.08 cm) to 3 inches (7.62 cm). In other embodiments, the height of the small spacer 233 may have different ranges.

For the single screen configuration, the large spacer 232 is configured to have a second spacer dimension selected to correspond to the single screen configuration. Large spacer 232-2 is selected to have the second spacer dimension to accommodate at least the lower shaker screen 212-1 and large spacer 232 within the track 210. The second spacer dimension may be the height of the large spacer 232 when positioned in the track 210 between the actuator 230 and the lower shaker screen 212-1. The height of the large spacer 232 may range from 3.5 inches (8.89 cm) to 4.5 inches (11.43 cm). In other embodiments, the height of the large spacer 232 may have different ranges. The multi-screen configuration needs to accommodate both the lower shaker screen 212-1 and the upper shaker screen 212-2 in the track 210, while the single shaker screen configuration does not need to accommodate both the lower shaker screen 212-1 and the upper shaker screen 212-2. Accordingly, the first spacer dimension of the small spacer 233 is less than the second spacer dimension of the large spacer 232.

When screen assembly 202 is in the multi-screen configuration, actuator 230 formed by bladder 236 may be actuated to place the screen assembly 210 in a clamped position and may be de-actuated to place the screen assembly 210 in an unclamped position. In the bladder 236 shown in FIG. 2B, a fluid media such as air, water, or any similar item is pumped via nozzle 238 into the bladder 236 causing the bladder 236 to expand and press down on the upper shaker screen 212-2. Upper shaker screen 212-2 transfers the force applied by the bladder 236 to the small spacer 233, seal 234, and lower shaker screen 212-1 to clamp and secure the lower shaker screen 212-1 at a lower level and the upper shaker screen 212-2 at an upper level in the track 210 of the screen assembly 202. The lower shaker screen 212-1 forms a lower deck and the upper shaker screen 212-2 forms an upper deck. The lower shaker screen 212-1 is disposed below the upper shaker screen 212-2 and is spaced apart from the upper shaker screen 212-2 by the small spacer 233.

The large spacer 232 used for the single screen configuration, shown in FIG. 2A, has a spacer dimension that is too large to be used in the multi-screen configuration shown in FIG. 2B, and has been replaced with the small spacer 233 for the multi-screen configuration. In this manner, the lower shaker screen 212-1 and the upper shaker screen 212-2 are clamped and/or pinned in place in the track 210 between the upper retainer 216 and the lower retainer 218. When in the clamped position, the lower shaker screen 212-1 and the upper shaker screen 212-2 are clamped in the track 210.

Figure 3A:
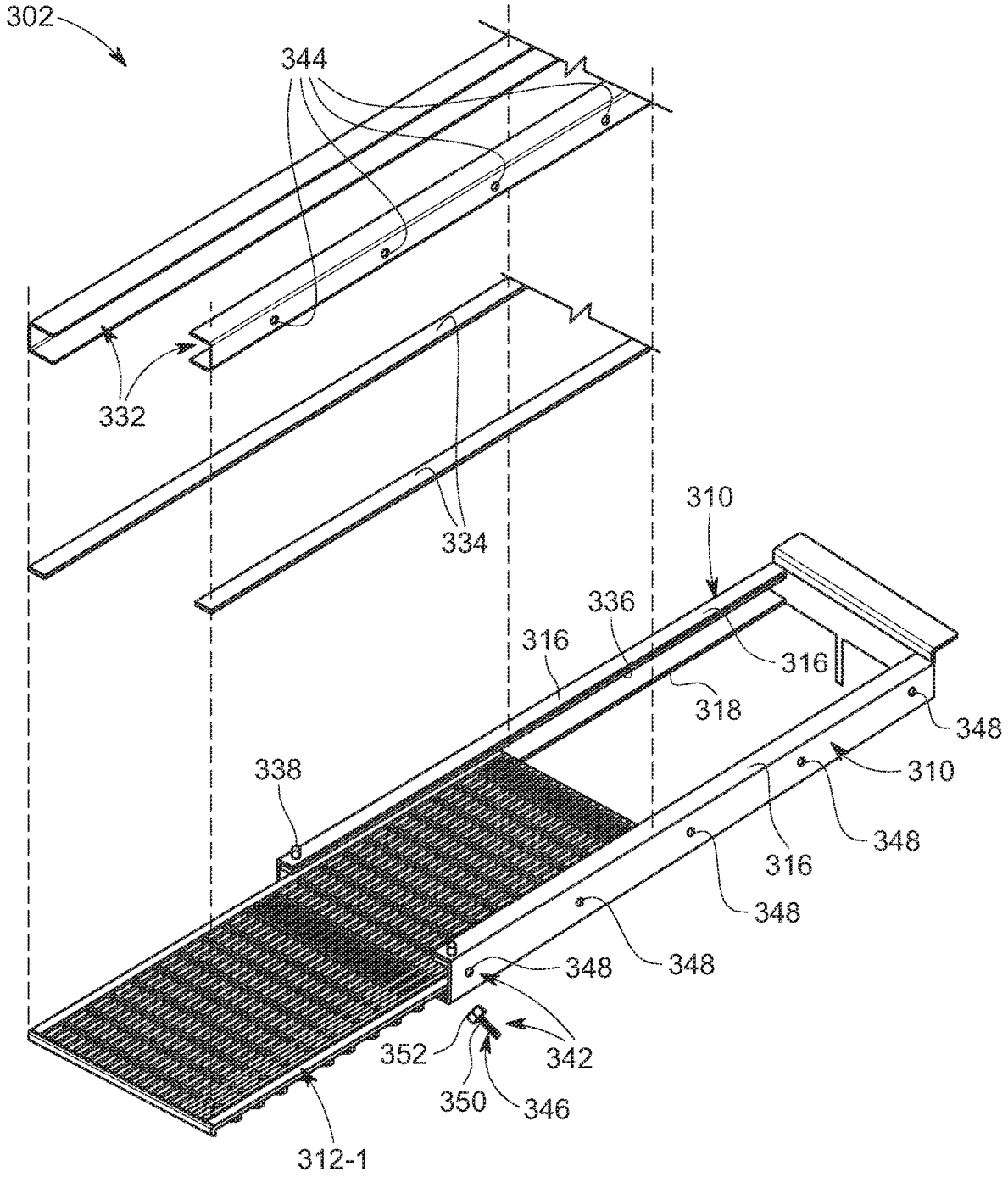
FIG. 3A shows an assembly view of an embodiment of the screen assembly being installed in the single screen configuration of the present disclosure.
Figure 3B:
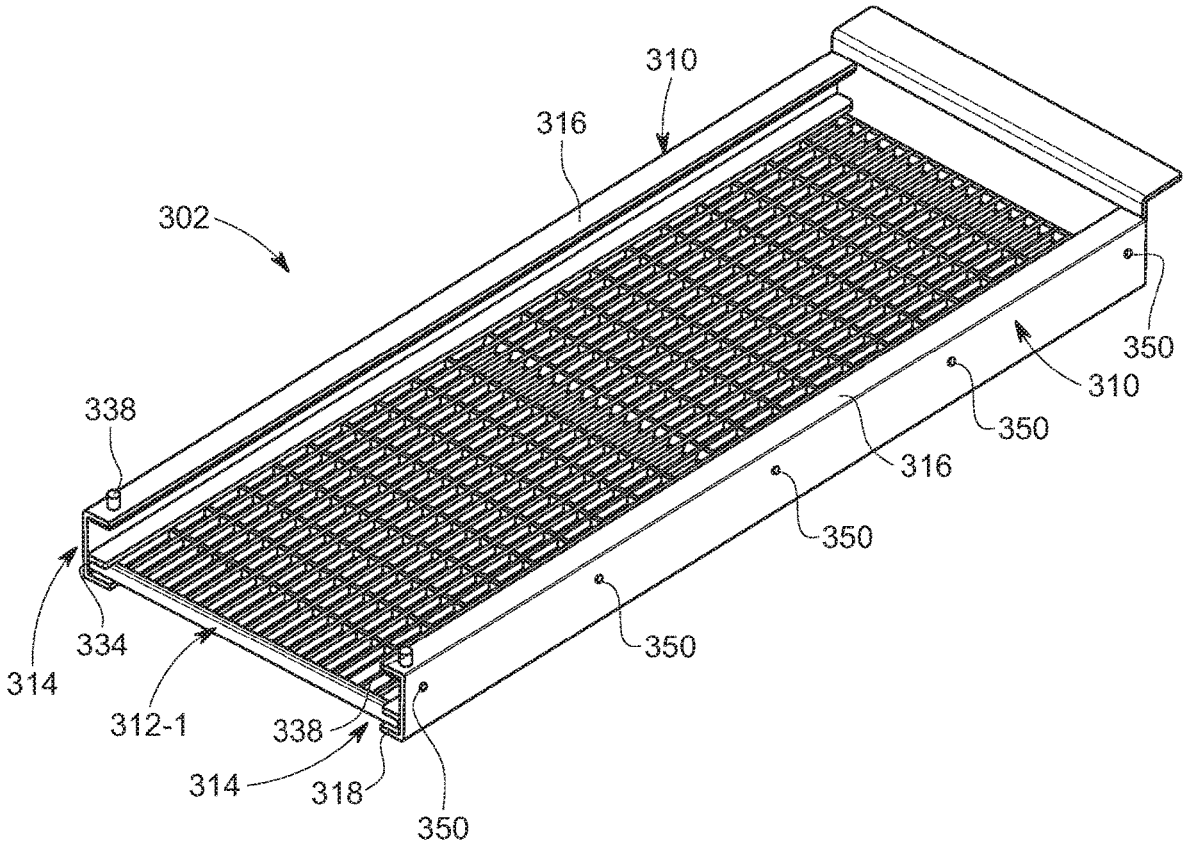
FIG. 3B shows a view of an embodiment of the screen assembly installed in the single screen configuration of the present disclosure.

FIG. 3A shows an assembly view of an embodiment of a screen assembly 302 being installed in the single screen configuration, and FIG. 3B shows the screen assembly 302 in the single screen configuration after installation. Screen assembly 302 includes a spaced-apart pair of tracks 310, a lower shaker screen 312-1, and a pair of screen clamping assemblies 314. Screen clamping assemblies 314 are referenced with numeral 314 in FIG. 3B and FIG. 3D. Tracks 310 each have an upper retainer 316, a lower retainer 318 with a screen clamping assembly 314 disposed in each track 310. Screen clamping assemblies 314 each include a seal 334, a large spacer 332, a bladder 336, and nozzle 338. Bladders 336 extend adjacent to and below the upper retainers 316.

Lower shaker screen 312-1 is shown being slid into tracks 310 as part of the installation process to install or assemble the screen assembly 302 from an un-installed position to an installed position. Lower shaker screen 312-1 abuts the lower retainers 318 while being slid into the tracks 310. Seals 334 may be slid in the tracks 310 above the lower shaker screen 312-1 that has been installed in the tracks 310. Seals 334 may be a separate component that may be slid in separately into the tracks 310. In other embodiments, seals 334 may be integral with the large spacers 332. Large spacers 332 then may be placed in the tracks 310 above the seals 334 to place the screen assembly 302 in the single screen configuration. In some embodiments, bladders 336 are in a de-actuated position when the large spacers 332 are slid into the tracks 310 to allow for enough space for the large spacers 332 to be slid in the tracks 310 above the lower shaker screen 312-1. In some embodiments, the large spacers 332 may be positioned between the lower retainers 316 and the lower shaker screen 312-1 with the seals 334 positioned between the lower shaker screen 312-1 and the large spacers 332. In the embodiment where the large spacers 332 are positioned below the lower shaker screen 312-1, the large spacers 332 act as wear strip for supporting the screens.

A spacer retainer assembly 342 in an un-installed position is shown in FIG. 3A. Spacer retainer assembly 342 includes a spacer retainer 346 that fits into a spacer keyway 344 in the large spacer 332. Spacer retainer 346 may include an elongated section 350 and a head section 352. In some embodiments, spacer retainer assembly 342 further includes a track retainer slot 348 in the track 310. The track retainer slot 348 is sized to allow the elongated section 350 of the spacer retainer 346 to fit therein. The elongated section 350 of the spacer retainer 346 fits in the spacer keyway 344 in the large spacer 332 and extends into the track retainer slot 348. The head section 352 of the spacer retainer 346 is sized to be larger than the spacer keyway 344 to secure the large spacer 332 in place in the tracks 310. In some embodiments, spacer retainer 346 is mechanically attached to the track 310, for example by a press fit or screw threads on the spacer retainer 346 that screw into mating screw threads in the track retainer slot 348.

Spacer retainer assembly 346 may be placed in an installed position by inserting the elongated section 350 of the spacer retainer 346 in the spacer keyway 344 and in the track retainer slot 348. In some embodiments, there may be multiple spacer retainer assemblies 342 spaced apart from one another along the length of the large spacers 332 for use in holding the large spacers 332 in place in the tracks 310. Spacer retainers 342 provides the benefit of holding the large spacers 332 in place in the tracks 310 when the screen assembly 302 is in the unclamped position and to secure the large spacers 332 in alignment in the tracks 310.

With the spacer retainer 342 in the installed position, screen assembly 302 is in the single screen configuration shown in FIG. 3B. Bladders 336 may then be actuated to place the screen assembly 302 in the clamped position.

Figure 3C:
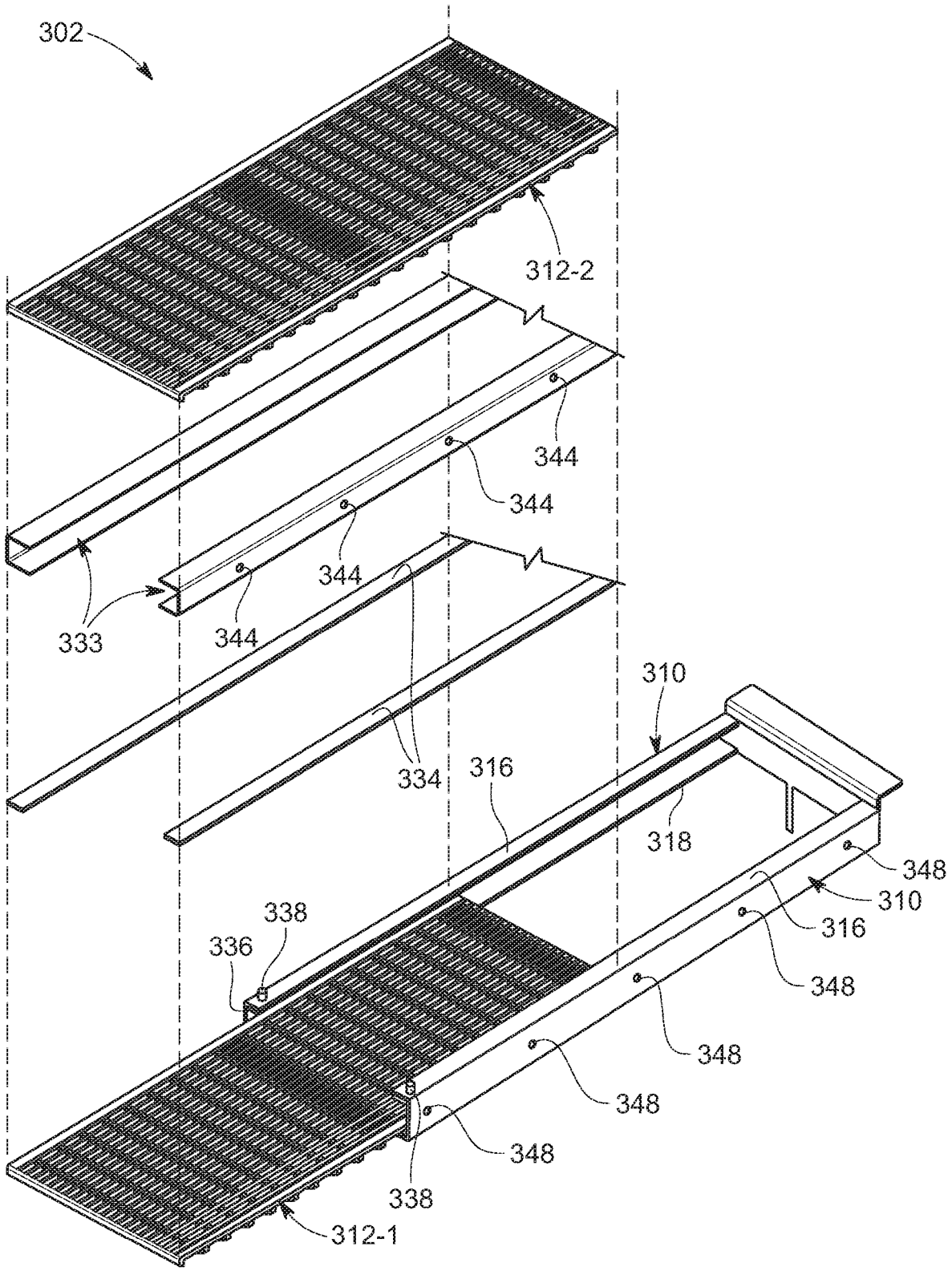
FIG. 3C shows an assembly view of an embodiment of the screen assembly being installed in the multi-screen configuration of the present disclosure.
Figure 3D:
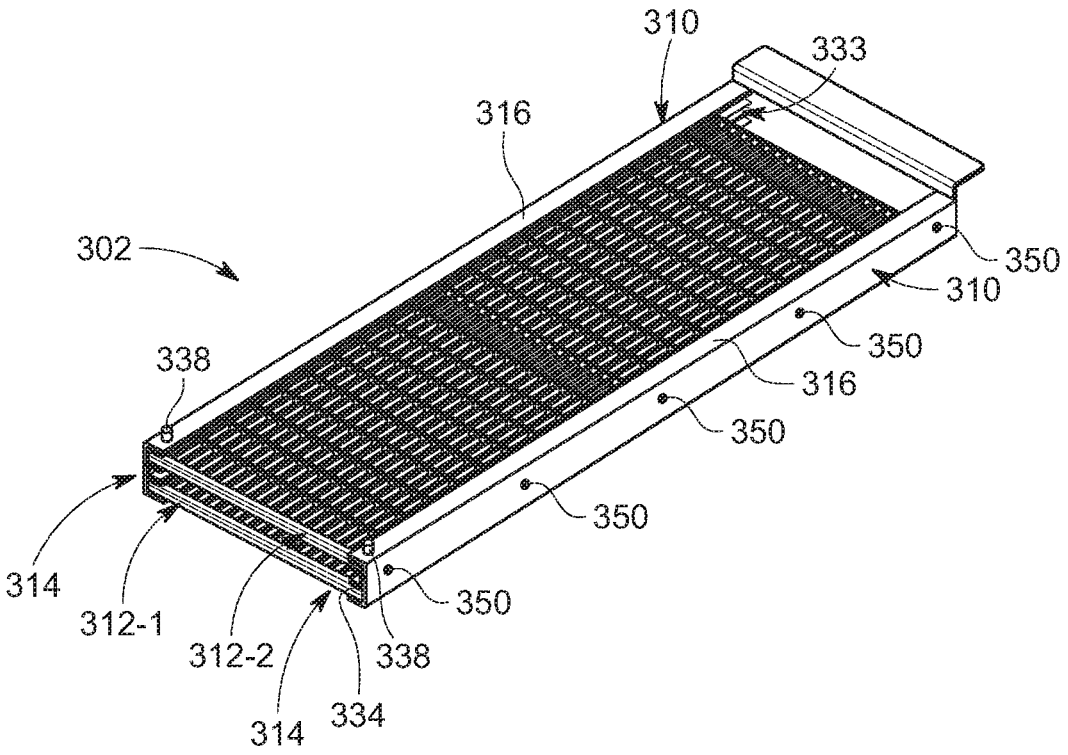
FIG. 3D shows a view of an embodiment of the screen assembly installed in the multi-screen configuration of the present disclosure.

FIG. 3C shows an assembly view of an embodiment of a screen assembly 302 being installed in the multi-screen configuration, and FIG. 3D shows the screen assembly 302 in the multi-screen configuration after installation. When in the multi-screen configuration, screen assembly 302 includes the lower screen 312-1 in addition to an upper shaker screen 312 that is spaced from the lower shaker screen by a small spacer 333.

Lower shaker screen 312-1 is shown being slid into tracks 310 as part of the installation process to install or assemble the screen assembly 302 from an un-installed position to an installed position. Lower shaker screen 312-1 abuts the lower retainers 318 while being slid into the tracks 310. Seals 334 may be slid in the tracks 310 above the lower shaker screen 312-1 that has been installed in the tracks 310. In some embodiments, seals 334 may be integral with the small spacer 333. Small spacers 333 may be placed into the tracks 310 above the seals 334. Small spacers 333 are secured to the tracks 310 by the spacer retainers 346. In some embodiments, the small spacers 333 hang from the spacer retainers 346 in the tracks 310. In some embodiments, there may be multiple spacer retainer assemblies 342 spaced apart from one another along the length of the tracks 210 and small spacers 333 to allow the small spacers 233 to be secured with the multiple space retainer assemblies 342 in the tracks 210. Upper shaker screen 312-2 is inserted in the tracks 310 above the small spacers 333.

In some embodiments, bladders 336 are in a de-actuated position when the large spacers 332 are slid into the tracks 310 to allow for enough space for the upper shaker screen 312-2 to be slid in the tracks 310 above the small spacers 332 and lower shaker screen 312-1 to place the screen assembly 302 in the multi-screen configuration shown in FIG. 3D. Bladders 336 may then be actuated to place the screen assembly 302 in the clamped position.

Figure 4:
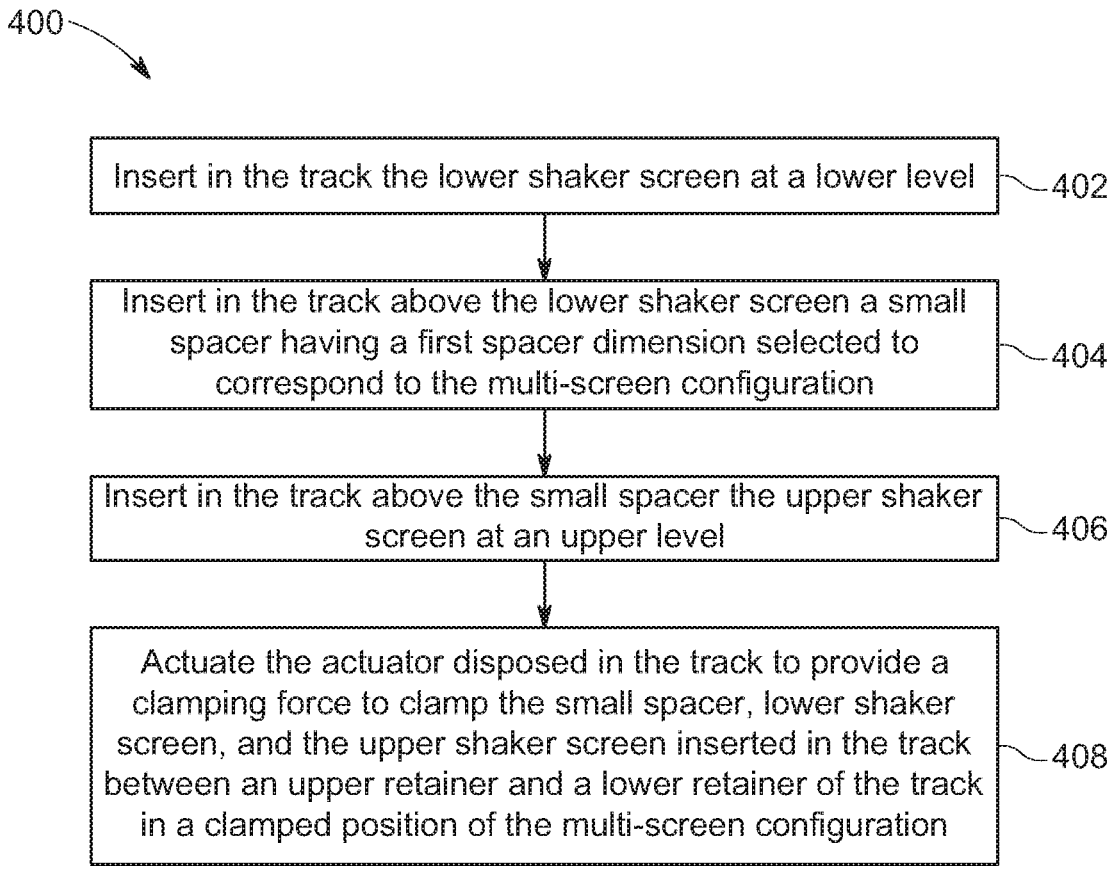
FIG. 4 shows a flowchart depicting a method for installing the screen assembly in the multi-screen configuration of the present disclosure.

FIG. 4 is a flowchart showing an embodiment of an installation method 400 for installing a screen assembly of a vibratory separator in a multi-screen configuration of the present disclosure. The screen assembly in the multi-screen configuration includes a lower shaker screen, an upper shaker screen, a track, and an actuator disposed in the track. The installation method 400 begins by an installer inserting in the track the lower shaker screen at a lower level (block 402). The installer inserts in the track above the lower shaker screen a small spacer (block 404). The small spacer has a first spacer dimension selected to correspond to the multi-screen configuration. The installer inserts in the track above the small spacer the upper shaker screen at an upper level (block 406). The small spacer is configured to separate the lower shaker screen from the upper shaker screen so that a lower screen deck is formed by the lower shaker screen and an upper screen deck is formed by the upper shaker screen. The lower shaker screen, small spacer, and upper shaker screen may be slid into the track during installation and may be slid into a pair of spaced-apart tracks.

A clamping assembly includes the actuator and is used to clamp the lower shaker screen and the upper shaker screen in the track. The installer actuates the actuator disposed in the track to provide a clamping force to clamp the small spacer, lower shaker screen, and the upper shaker screen inserted in the track between an upper retainer and a lower retainer of the track in a clamped position of the multi-screen configuration (block 408). When in the installed position, the screen assembly in the multi-screen configuration clamps the lower shaker screen and the upper shaker screen in the track so that the screen assembly is ready to withstand the vibrations during operations.

In operation, the screen assembly in the multi-screen configuration has a lower screen deck formed by the lower shaker screen and an upper screen deck formed by the upper shaker screen. Drilling fluid, along with drill cuttings and debris, may be deposited on top of the upper shaker screen at the feed end. The screen assembly may be vibrated (e.g., 25-40 Hz frequency range) by a motor or motors for the purpose of screening or separating the drilling fluid on the upper shaker screen. The liquid and fine particles of the drilling fluid may pass through the upper shaker screen by force of gravity and acceleration caused by the motor and flows through the space between the upper shaker screen and the lower shaker screen and is deposited on the lower shaker screen forming a spaced-apart, lower screen deck. The liquid and fine particles of the drilling fluid after filtering by the upper shaker screen may pass through the lower shaker screen by force of gravity and acceleration caused by the motor and may be recovered underneath the lower shaker screen and screen assembly.

Solid particles greater than a certain size may migrate and vibrate across both the upper shaker screen and the lower shaker screen where they may be discharged at the discharge end. The filtering elements of the upper shaker screen may define the largest solid particle capable of passing therethrough. The filtering elements of the lower shaker screen may define the largest solid particle capable of passing therethrough. In some embodiments, the filtering elements of the upper shaker screen may define larger solid particles capable of passing through the filter elements of the upper shaker screen compared to the filtering elements of the lower shaker screen. In some embodiments, the filtering elements of the upper shaker screen and the lower shaker screen are the same.

Figure 5:
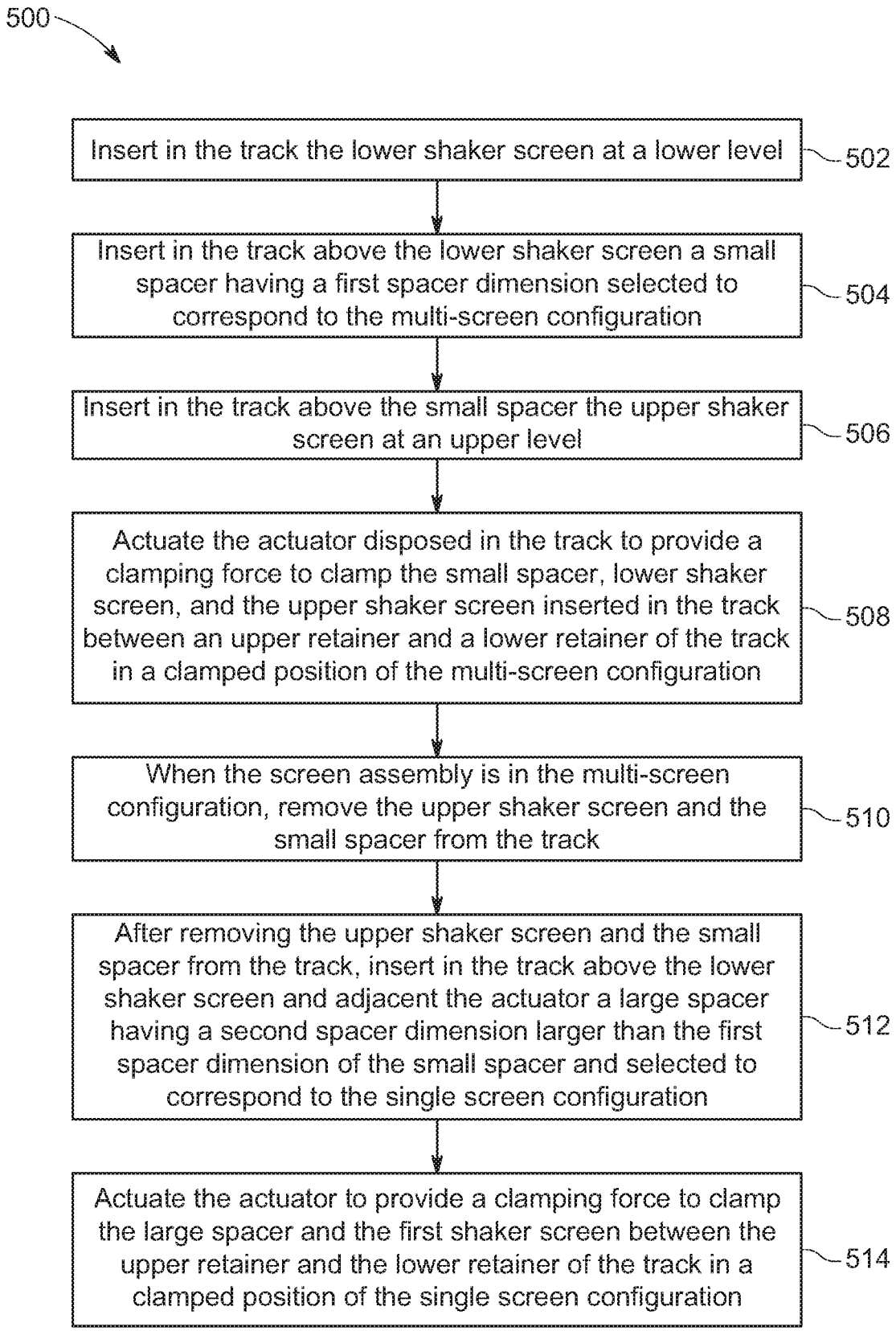
FIG. 5 shows a flowchart depicting a method for installing the screen assembly between a multi-screen configuration and a single screen configuration of the present disclosure.

FIG. 5 is a flowchart showing an embodiment of an installation method 500 for installing a screen assembly of a vibratory separator between a multi-screen configuration and a single screen configuration of the present disclosure. The installation method 500 for installing the screen assembly in the multi-screen configuration includes the blocks 502-508 that are the same as the installation method 400 for installing the screen assembly in the multi-screen configuration described with respect to FIG. 4. Blocks 502-508 are performed as described with respect to blocks 402-408 of FIG. 4. When the screen assembly is in the multi-screen configuration, an installer may remove the upper shaker screen and the small spacer from the track (block 510). In some embodiments, before removing the upper shaker screen and the small spacer (block 510), the installer may de-actuate the actuator to position the screen assembly in the multi-screen configuration from a clamped position to an unclamped position. The upper shaker screen and small spacer may be removed from the tracks. After removing the upper shaker screen and the small spacer from the track, the installer inserts in the track above the lower shaker screen and adjacent the actuator a large spacer (block 512). The large spacer has a second spacer dimension larger than the first spacer dimension of the small spacer and is selected to correspond to the single screen configuration. The large spacer may be slid into the track during installation and may be slid into the pair of spaced-apart tracks. The installer may actuate the actuator to provide a clamping force to clamp the large spacer and the first shaker screen between the upper retainer and the lower retainer of the track in a clamped position of the single screen configuration (block 514). When in the clamped position, the screen assembly is installed in the single screen configuration and the screen assembly is ready to withstand the vibrations during operations.

In operation, the screen assembly in the single screen configuration has a lower screen deck formed by the lower shaker screen. Drilling fluid, along with drill cuttings and debris, may be deposited on top of the lower shaker screen at the feed end. The screen assembly may be vibrated (e.g., 25-40 Hz frequency range) by a motor or motors for the purpose of screening or separating the drilling fluid on the lower shaker screen. The liquid and fine particles of the drilling fluid may pass through the lower shaker screen by force of gravity and acceleration caused by the motor and flows and may be recovered underneath the lower shaker screen and screen assembly.

Figure 6:
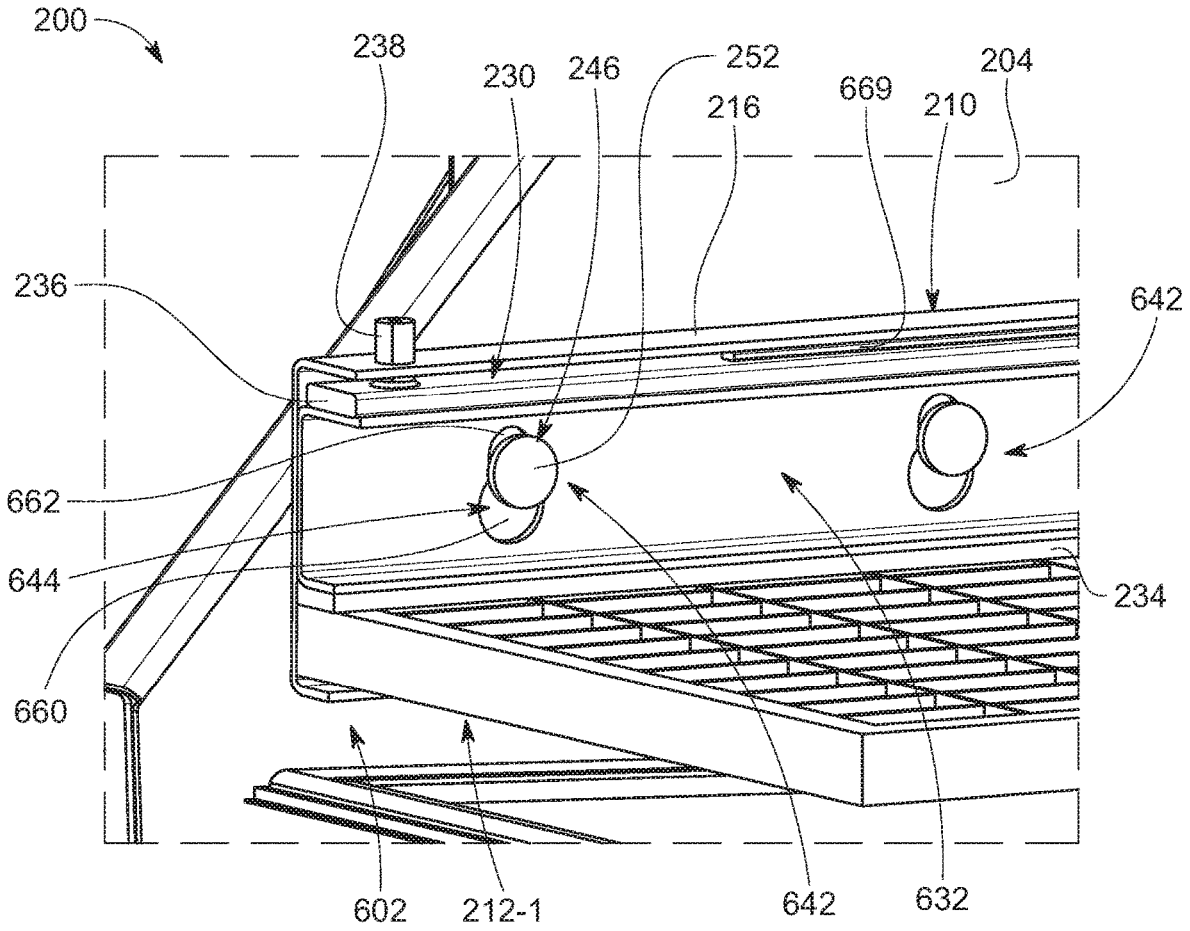
FIG. 6 shows a perspective partial view of an embodiment of the screen assembly installed in the vibratory separator in the single screen configuration of the present disclosure.

FIG. 6 shows a partial view of a screen assembly 602 installed in a vibratory separator 200 in a single screen configuration, in accordance with at least one embodiment of the present disclosure. Like components of embodiments of the screen assemblies are labeled with like reference numbers. In FIG. 6, large spacer 632 is shown installed in the track 210 by spacer retainer 246 disposed in a spacer keyway 644. Spacer keyway 644 may be a "T" slot or other slot cut into the large spacer 632 configured to permit large spacer 632 to be hooked onto the spacer retainer 246 to install the large spacer 632 in the track 210 and unhooked from the spacer retainer 246 to remove the large spacer 632 from the track 210.

Spacer keyway 644 includes a first slot section 660 and a second slot section 662. For example, the spacer keyway 644 may be configured to allow vertical movement of the large spacer 632 hooked on the spacer retainer 246 to accommodate movement of the large spacer 632 when positioned between the clamped position and the unclamped position in the track 210. This vertical movement of the large spacer 632 when attached to the spacer retainer 246 allows the large spacer 632 to be vertically moved in the track 210 to unhook the large spacer 632 from the spacer retainer 246 to remove the large spacer 632 from the track 210.

When the large spacer 632 is positioned in the clamped position, the second slot section 662 of the spacer keyway 644 is adjacent to and abuts against the head section 252 of the spacer retainer 246 preventing the large spacer 632 from moving outwardly and away from the track 210, as shown in FIG. 6. When the large spacer 632 is positioned in the unclamped position, the large spacer 632 may be moved upwards in the track 210 to position the first slot section 660 of the spacer keyway 644 adjacent to the head section 252 of the spacer retainer 246. First slot section 660 of the spacer keyway 644 is configured to be larger than the second slot section 662 of the spacer keyway 644 and head section 252 of the spacer retainer 246. With the large spacer 632 in this position, the head section 252 may be removed through the first slot section 660 of the spacer keyway 644 and the large spacer 632 may be removed from the track 210.

Spacer keyway 644 and spacer retainer 246 form a spacer retainer assembly 642. Multiple spacer retainer assemblies 642 are spaced apart from one another along the length of the large spacer 632. FIG. 6 shows two spacer retainer assemblies 642, and additional spacer retainer assemblies 642 may be spacer apart along the length of the large spacers 632. Spacer retainer assemblies 642 may be used for both large spacers 632 and small spacers 233 configured with retainer assemblies 642. The spacer retainer assemblies 642 provide the advantage of allowing an installer to slip either the large spacers 632 or small spacers 233 on the spacer retainers 246 so that the large spacers or small spacers sit on the spacer retainers 246 with the spacer retainers 246 extending in respective spacer keyways 644. The installer may change between large spacers 632 and small spacers 233 without the use of tools and to position the screen assembly 602 between the single screen configuration and the multi-screen configuration. The installer installs and uninstalls the large spacers 632 or small spacers 233 on or off the spacer retainers 246 when the actuator 230 is in in the de-actuated position.

Actuator 230 is actuated to provide a force that holds the large spacers 632 and lower shaker screen 212-1 in place in the tracks 210 when in the clamped position of the single screen configuration or the small spacers 233, lower shaker screen 212-1, and upper shaker screen 212-2 in place in the tracks 210 when in the clamped position of the multi-screen configuration. An actuator seal 669 may be disposed between the upper retainer 216 and the bladder 236 of the actuator 230. When moving from the unclamped position to the clamped position, the force from the actuator 230 may move the large spacers 632 downwards and the spacer keyways 644 may move downward with respect to the spacer retainers 246 that are fixed with respect to tracks 210 to position the retainer head sections 252 in the second slot sections 662 of the respective spacer keyways 644. Retainer head sections 252 block the large spacers 632 from moving out of the tracks 210 when the vibratory separator 200 vibrates the screen assembly 602.

Figure 7A:
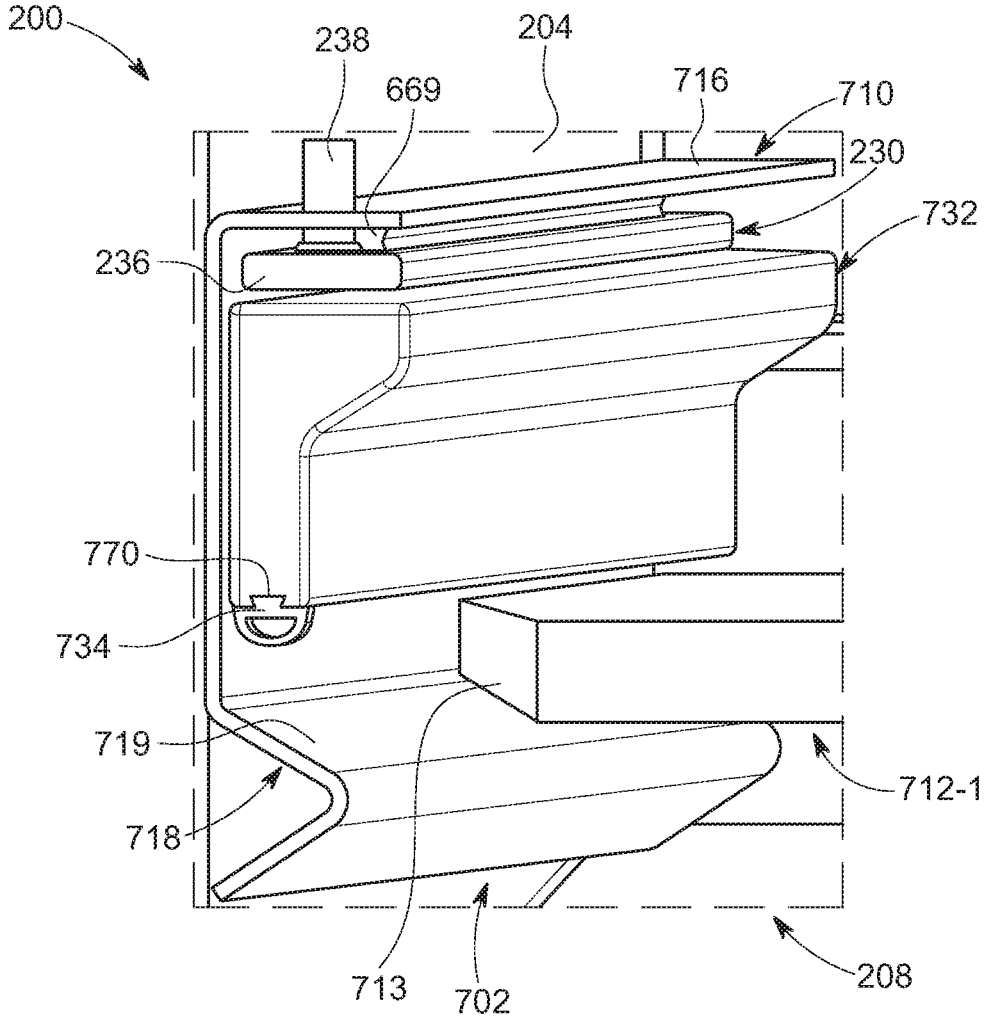
FIG. 7A shows a perspective partial view of an embodiment of the screen assembly installed in the vibratory separator in the single screen configuration of the present disclosure.

FIG. 7A shows a partial view of a screen assembly 702 installed in the vibratory separator 200 in the single screen configuration, in accordance with at least one embodiment of the present disclosure. Like components of embodiments of the screen assemblies are labeled with like reference numbers. FIG. 7A shows a view from a discharge end 208 of the left section of the vibratory separator 200. Screen assembly 702 includes a pair of tracks 710 and a lower shaker screen 712-1. Screen assembly 702 further includes disposed in each track a large spacer 732, an actuator 230, and a seal 734. FIG. 7A shows the seal 734 disposed in a channel 770. Track 710 includes an upper retainer 716 and a lower retainer 718. The lower retainer 718 includes an upper surface 719, and the lower shaker screen 712-1 rests on and is supported by the upper surface 719 of the lower retainer 718. In some embodiments, the upper surface 719 may be disposed at a thirty-degree angle with respect to the inner wall 204 to help limit solids build-up on the lower retainer 718 during operations. In some embodiments, the lower shaker screen 712-1 has a bottom surface 713 having an angle that matches the angle of the upper surface 719 of the lower retainer 718.

Figure 7B:
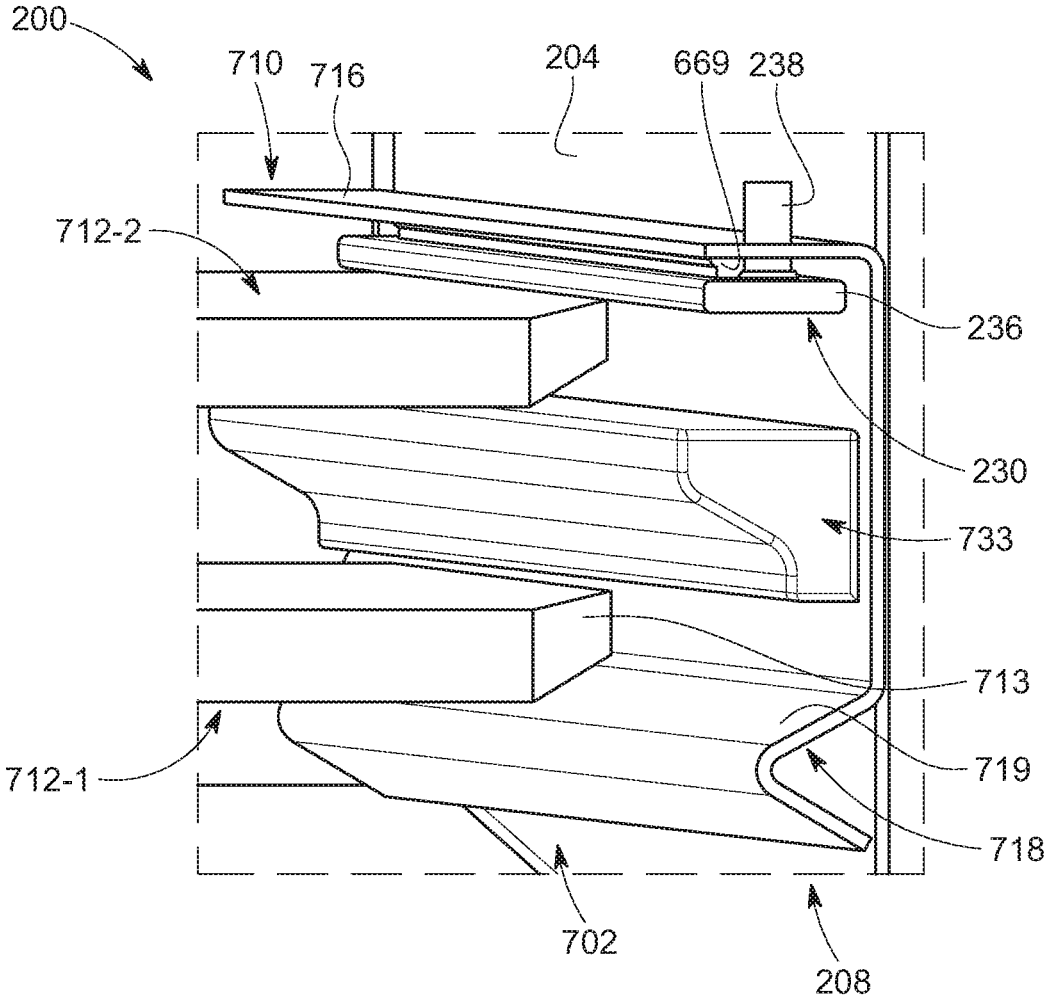
FIG. 7B shows a perspective partial view of an embodiment of the screen assembly installed in the vibratory separator in the multi-screen configuration of the present disclosure.

FIG. 7B shows a partial view of the screen assembly 702 installed in the vibratory separator 200 in the multi-screen configuration, in accordance with at least one embodiment of the present disclosure. FIG. 7B shows a view from a discharge end 208 of the right section of the vibratory separator 200. The screen assembly 702 includes tracks 710, a lower shaker screen 712-1, and an upper shaker screen 712-2. Screen assembly 702 further includes disposed in each track 710 the large spacers 733 and the actuator 230. In some embodiments, a seal (not shown) may be disposed in a channel (not shown) in the small spacer 733 in a manner as shown in FIG. 7A and FIG. 10 for the large spacer 732. The lower shaker screen 712-1 rests on and is supported by the upper surface 719 of the lower retainer 718. Upper shaker screen 712-2 is disposed above and rests on small spacer 733. In some embodiments, large spacers 732 and small spacers 733 are made with materials that are moldable, including urethane.

Figure 7C:
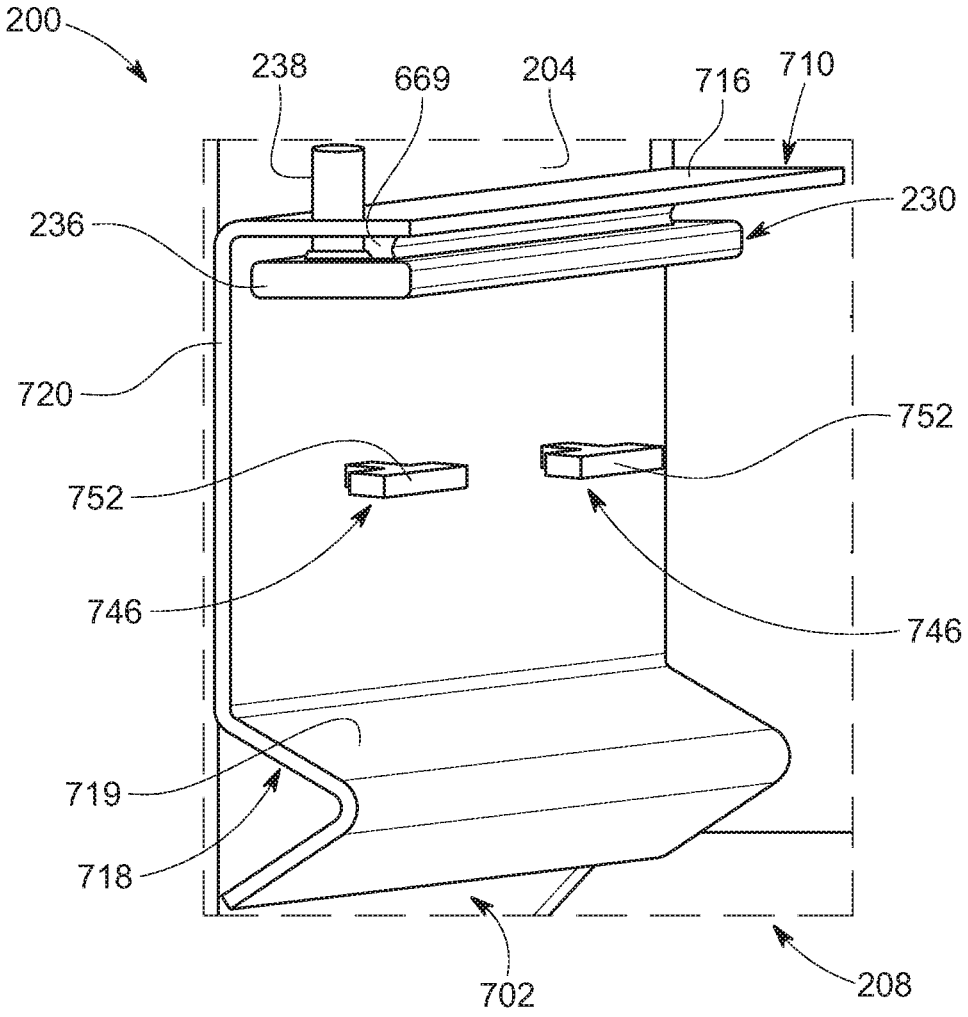
FIG. 7C shows a perspective partial view of an embodiment of the screen assembly installed in the vibratory separator in an uninstalled screen configuration of the present disclosure.

FIG. 7C shows a partial view of a screen assembly 702 installed in the vibratory separator 200 in an uninstalled screen configuration. When in the uninstalled screen configuration, the large spacer 732 and the small spacer 733 are removed from the tracks 710. Spacer retainers 746 are spaced apart along the length of the track 710. Each spacer retainer 746 extends from a fixture wall 720 of the track 710 and is disposed in the track channel. Each spacer retainer 746 includes a head section 752. In some embodiments, the spacer retainer 746 has a "T" shape. In some embodiments, the spacer retainer 746 has other shapes. Spacer retainer 746 may be attached to the track 710 and/or inner wall 204 by welding or other attachment mechanism, as discussed with respect to spacer retainer 246.

Spacer retainers 746 allow an installer to position the screen assembly 702 between the single screen configuration and the multi-screen configuration without the use of tools. When the screen assembly 702 is in the uninstalled screen configuration, large spacers 732 may be attached to the spacer retainers 746 so that each large spacer 732 may be suspended in one of the tracks 710, and the lower shaker screen 712-1 and seal 734 may be inserted into each track 710 to place the screen assembly 702 in the single screen configuration. Likewise, when the screen assembly 702 is in the uninstalled screen configuration, small spacers 733 may be attached to the spacer retainers 746 so that each small spacer 733 may be suspended in one of the tracks 710, and the lower shaker screen 712-1, upper shaker screen 712-2, and seal 734 may be inserted into each track 710 to place the screen assembly 702 in the multi-screen configuration.

Figure 8:
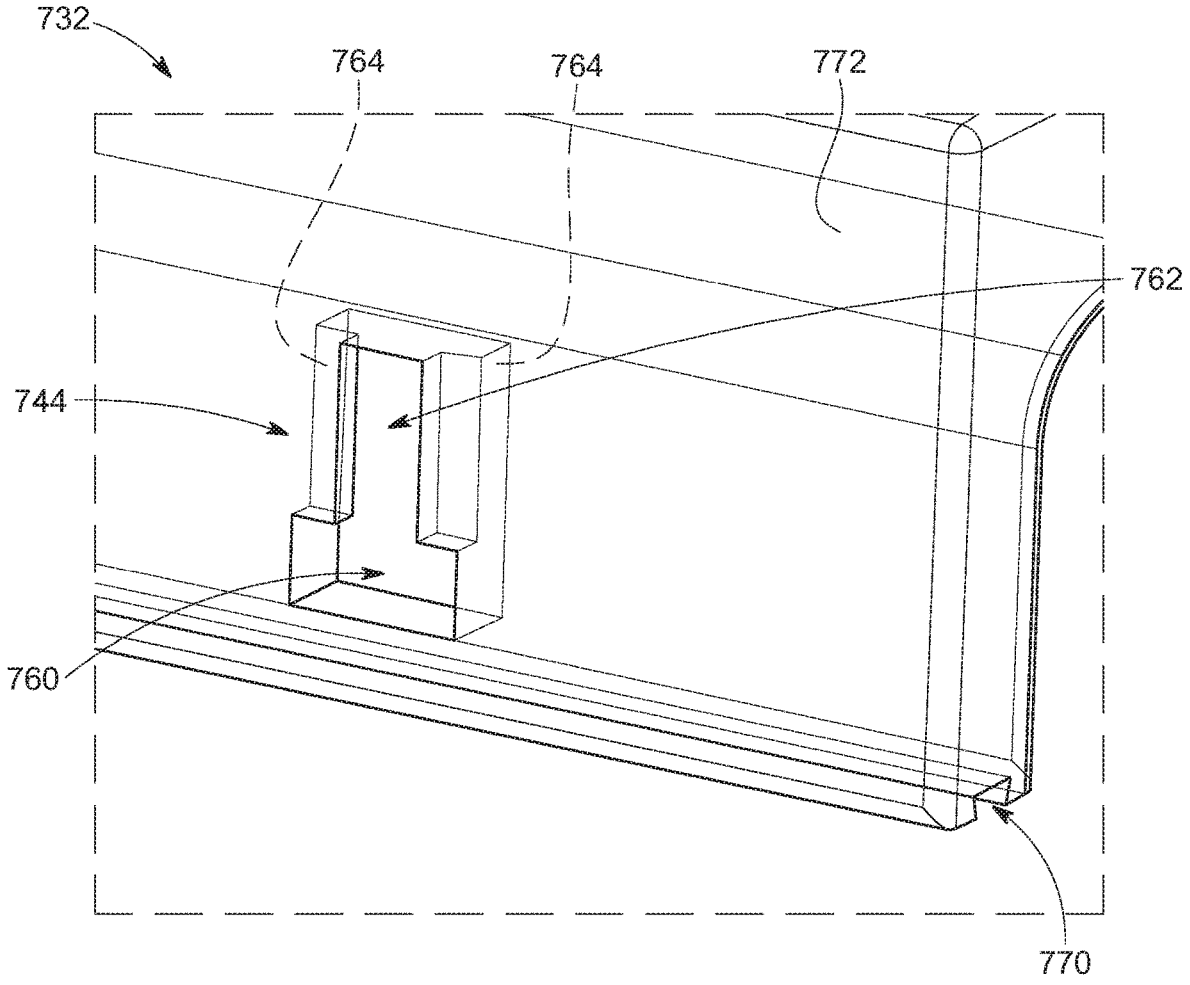
FIG. 8 shows a perspective partial view of an embodiment of a large spacer of the screen assembly shown in FIG. 7A.
Figure 9:
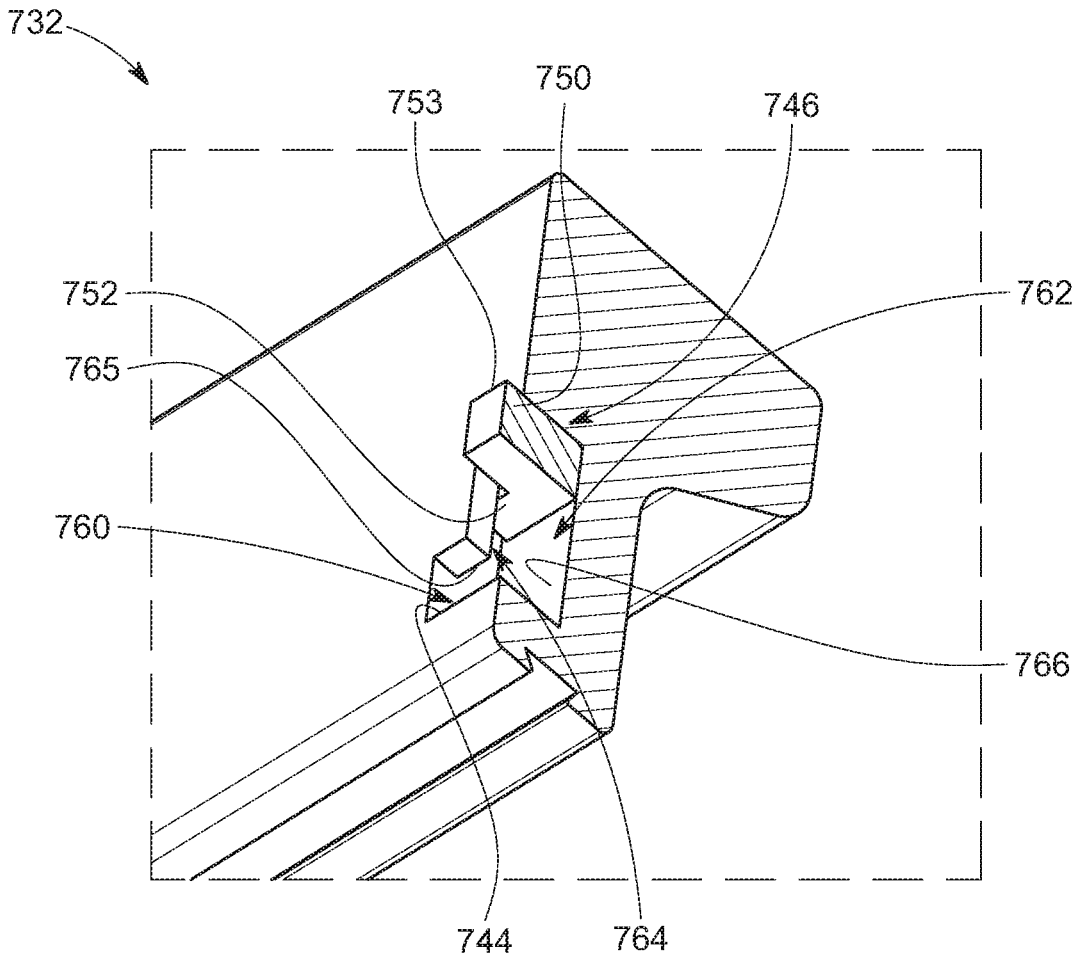
FIG. 9 shows a perspective cross-sectional, partial view of an embodiment of the large spacer of the screen assembly shown in FIG. 7A.

Referring to FIG. 8 and FIG. 9, the large spacer 732 with a spacer keyway 744 is shown. FIG. 8 shows a partial perspective view of the large spacer 732 having one of the spacer keyways 744. Spacer keyway 744 is shown disposed in a spacer back surface 772 of the large spacer 732. Spacer keyway 744 may also be disposed in small spacer 733 in a similar manner. Spacer keyway 744 includes a first slot section 760 and a second slot section 762. First slot section 760 may be a lower slot section and the second slot section 762 may be an upper slot section, as shown in FIG. 8. Spacer keyway 744 further includes a pair of sockets 764 disposed on opposite sides of the second slot section 762, as depicted in FIG. 8. Spacer keyway 744 further includes a first internal surface 765 and second internal surface 766 that define each socket 764.

Large spacer 732 or small spacer 733 may be attached to the spacer retainers 746 by inserting the spacer retainers 746 into respective spacer keyways 744. Each spacer retainer 746 is aligned with one of the spacer keyways 734. Each spacer retainer 746 includes an elongated section 750 and the head section 752. Head section 752 of the spacer retainer 746 is inserted into the first slot section 760. Head section 752 is configured to fit within the first slot section 760 and to be slidable into the second slot section 762 as the large spacer 732 or small spacer 733 is moved downward with respect to the spacer retainer 746. As the head section 752 moves into the second slot section 762, the head section 752 moves through an opening between the first slot section 760 and the second slot section 762 and the head section is disposed in the sockets 764. The large spacer 732 or the small spacer 733 are positioned in a locked position when the head section 752 is positioned in the sockets 764. End portions of the head section 752 are disposed in the sockets 764 with opposing internal surfaces 765, 766 of the large spacer 732 or small spacer 733 adjacent to the head section 752 to block the large spacer 732 or small spacer 733 from moving outwardly from the track 710.

Referring to FIG. 9, one-half of the spacer retainer 746 and matching spacer keyway 762 is shown. Spacer retainer 746 is shown with a portion of the head section 752 inserted into one of the sockets 764. Another portion (not shown) of the head section 752 is inserted into an opposite socket 764 (not shown). When the spacer retainers 746 and the spacer keyways 762 are in this position, the large spacer 732 or small spacer 733 is in the locked position in the tracks 710.

After the large spacer 732 or the small spacer 733 has been attached to the spacer retainers 746, the other components of either the multi-screen configuration or the single screen configuration may be installed in the tracks 710. In some embodiments, the components of the screen assembly 732 may be installed in a different order. Actuator 230 may be actuated to provide a downward force to move either the large spacer 732 or the small spacer 733 downwards in the tracks 710 to position the large spacer 732 or small spacer 733 in a locked position. Each spacer retainer 746 is configured to move in its respective spacer keyway 744 to allow for downwards movement of the large spacer 732 or the small spacer 733 when the screen assembly 702 is placed in the clamped position. Likewise, each spacer retainer 746 is configured to move in its respective spacer keyway 744 to allow for upwards movement of the large spacer 732 or the small spacer 733 when the screen assembly 702 is placed in the unclamped position, Large spacer 732 or small spacer 733 may be uninstalled from the tracks 710 by moving the moving the large spacer 732 or the small spacer 733 upwards to align each spacer retainer 746 in the first section 760 of the matching spacer keyway 744 so that the spacer retainers 746 can be removed from the spacer keyways 734. Spacer retainers 746 are disposed in the spacer keyways 734 during operation of the vibratory separator 200. Spacer retainers 746 are protected from drilling fluids and contaminants during operation because the spacer retainers 746 are in the body of the large spacer 732 or the small spacer 733 during operations. The positioning of the spacer retainers 746 in the body of the large spacer 732 or small spacer 733 may help reduce maintenance needs and contaminant build-up on the spacer retainers 746 allowing for more effective attachment of the large spacer 732 and the small spacer 733 in the track 710.

The disclosed systems, devices, apparatus, and/or methods disclose screen assemblies for improved installation of one or more screens in different configurations. The screen assembly is positionable in a multi-screen configuration where the screen assembly includes a single screen deck that may be formed by a lower shaker screen. The screen assembly also allows for the screen assembly to be positioned in a multi-screen configuration that has a dual screen deck with a lower deck and an upper deck formed by the lower shaker screen and the upper shaker screen spaced apart by the small spacer. The screen assembly uses an actuator in the track to clamp the at least one shaker screen in both the single screen configuration and the multi-screen configuration.

The screen assembly of embodiments of the present disclosure provides the benefit of using one actuator for two different configurations. The screen assembly of embodiments of the present disclosure provides the benefit of using only one pair of tracks on opposite walls of the vibratory separator for the at least one shaker screen used for the different screen configurations that include a single screen deck formed by the lower shaker screen and a multi-screen deck formed by the lower shaker screen and the upper shaker screen. The screen assembly of embodiments of the present disclosure helps avoid the need for two different vibratory separators that would each have a separate screen configuration that may be needed for different operations. The screen assembly of embodiments of the present disclosure helps avoid the need to make substantial modifications to a vibratory separator to re-configure a vibratory separator to a different configuration. The screen assembly of embodiments of the present disclosure is configurable between the multi-screen configuration and single screen configuration without the need for tools.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims. The scope of the invention should be determined only by the language of the claims that follow. The term "comprising" within the claims is intended to mean "including at least" such that the recited listing of elements in a claim are an open group. The terms "a," "an" and other singular terms are intended to include the plural forms thereof unless specifically excluded. In the claims, means-plus-function clauses are intended to cover the structures described herein as performing the recited function and not only structural equivalents, but also equivalent structures. It is the express intention of the applicant not to invoke 35 U. S. C. § 112, paragraph 6 for any limitations of any of the claims herein, except for those in which the claim expressly uses the words "means for" together with an associated function.

What is claimed is:

1. A screen assembly comprising:

a lower shaker screen and an upper shaker screen, and wherein the screen assembly is configurable in a multi-screen configuration comprising the lower shaker screen and the upper shaker screen;

a track configured to be disposed on an inside wall of a vibratory separator and comprising an upper retainer and a lower retainer; and a screen clamping assembly disposed in the track, the screen clamping assembly comprising:

a small spacer having a first spacer dimension selected to correspond to the multi-screen configuration, and wherein the small spacer is disposed between the lower shaker screen and the upper shaker screen in the track to space the lower shaker screen at a lower level and the upper shaker screen at an upper level in the track when the screen assembly is in the multi-screen configuration; and an actuator disposed in the track and having a clamped position where the actuator is actuated to provide a clamping force to clamp the lower shaker screen, the upper shaker screen, and the small spacer between the upper retainer and the lower retainer of the track.

2. The screen assembly of claim 1, wherein the multi-screen configuration has an unclamped position where the actuator is de-actuated to release the clamping force on the lower shaker screen, the upper shaker screen and the small spacer; and wherein the lower shaker screen, upper shaker screen, and the small spacer are configured to be removed from the track when in the unclamped position of the multi-screen configuration.

3. The screen assembly of claim 2, wherein the upper retainer is configured to extend from an inner wall of a vibratory separator and the lower retainer is configured to extend from the inner wall of the vibratory separator, and wherein the actuator comprises a bladder disposed below the upper retainer, and wherein the bladder is inflatable to position the actuator in an actuated position and deflatable to position the actuator in a de-actuated position.

4. The screen assembly of claim 3, wherein the bladder comprises a nozzle configured to inflate and deflate the bladder, and wherein the upper retainer comprises a top retainer wall and the nozzle extends through the top retainer wall.

5. The screen assembly of claim 1, wherein the screen clamping assembly further comprises a screen seal, and wherein the screen seal is disposed between the small spacer and the lower shaker screen when the screen assembly is in the multi-screen configuration.

6. The screen assembly of claim 1, wherein the screen assembly is configurable in a single screen configuration and further comprises:

a first shaker screen;

a large spacer having a spacer dimension larger than the small spacer and sized to correspond to the single screen configuration, and wherein the large spacer is disposed adjacent the actuator and between the actuator and the first shaker screen to position the first shaker screen in the track at a first level when the screen assembly is in the single screen configuration;

wherein the single screen configuration has a clamped position where the actuator is actuated to provide a clamping force to clamp the larger spacer and the first shaker screen between the upper retainer and the lower retainer of the track.

7. The screen assembly of claim 6, wherein the single screen configuration has an unclamped position where the actuator is de-actuated to release the clamping force on the first shaker screen and the large spacer; and wherein the first shaker screen and the large spacer are configured to be removed from the track when in the unclamped position of the single screen configuration.

8. The screen assembly of claim 7, wherein when the screen assembly is in the multi-screen configuration, the upper retainer extends over at least a portion of a top surface of the upper shaker screen, a top surface of the lower shaker screen, and a top surface of the small spacer, and the lower retainer extends under at least a portion of a bottom surface of the lower shaker screen, a bottom surface of the upper shaker screen, and a bottom surface of the small spacer; and wherein when the screen assembly is in the single screen configuration the upper retainer extends over at least a portion of a top surface of the first shaker screen and a top surface of the large spacer, and the lower retainer extends under at least a portion of a bottom surface of the first shaker screen and a bottom surface of the large spacer.

9. The screen assembly of claim 6, wherein the screen clamping assembly further comprises a screen seal, wherein the screen seal is disposed between the small spacer and the lower shaker screen when the screen assembly is in the multi-screen configuration, and wherein the screen seal is disposed between the large spacer and the first shaker screen when the screen assembly is in the single screen configuration.

10. The screen assembly of claim 6, wherein the screen clamping assembly further comprises a spacer retainer assembly, and wherein the spacer retainer assembly comprises:

a spacer keyway in the large spacer; and a spacer retainer sized for the spacer keyway disposed in the track and configured to secure the large spacer in the track.

11. A method for installing a screen assembly of a vibratory separator, comprising:

installing the screen assembly in a multi-screen configuration, wherein the screen assembly has a lower shaker screen, an upper shaker screen, a track, and an actuator disposed in the track, and comprising:

inserting in the track the lower shaker screen at a lower level;

inserting in the track above the lower shaker screen a small spacer having a first spacer dimension selected to correspond to the multi-screen configuration;

inserting in the track above the small spacer the upper shaker screen at an upper level; and actuating the actuator disposed in the track to provide a clamping force to clamp the small spacer, lower shaker screen, and the upper shaker screen inserted in the track between an upper retainer and a lower retainer of the track in a clamped position of the multi-screen configuration.

12. The method of claim 11, further comprising:

when in the clamped position of the multi-screen configuration, de-actuating the actuator to release the clamping force to position the screen assembly in an unclamped position where the actuator is de-actuated to release the clamping force on the lower shaker screen, the upper shaker screen and the small spacer; and when in the unclamped position of the multi-screen configuration, slidably removing the lower shaker screen, upper shaker screen, and the small spacer from the track.

13. The method of claim 11, further comprising installing the screen assembly into a single screen configuration, comprising:

inserting a first shaker screen into the track at a first level;

inserting in the track above the first shaker screen and adjacent the actuator a large spacer having a second spacer dimension larger than the first spacer dimension of the small spacer and selected to correspond to the single screen configuration; and actuating the actuator to provide a clamping force to clamp the large spacer and the first shaker screen inserted in the track between the upper retainer and the lower retainer of the track in a clamped position of the single screen configuration.

14. The method of claim 13, wherein the first shaker screen is the lower shaker screen.

15. The method of claim 13, wherein installing the screen assembly in the single screen configuration further comprises securing the large spacer in the track with a spacer retainer assembly, and wherein the spacer retainer assembly comprises a spacer keyway in the large spacer and a spacer retainer sized for the spacer keyway and extending through the spacer keyway for securing the large spacer in the track.

16. A method for configuring a screen assembly on a vibratory separator between a multi-screen configuration and a single screen configuration, comprising:

installing the screen assembly in a multi-screen configuration, wherein the screen assembly has a lower shaker screen, an upper shaker screen, a track, and an actuator disposed in the track, and comprising:

inserting in the track the lower shaker screen at a lower level;

inserting in the track above the lower shaker screen a small spacer having a first spacer dimension selected to correspond to the multi-screen configuration;

inserting in the track above the small spacer the upper shaker screen at an upper level; and actuating the actuator disposed in the track to provide a clamping force to clamp the small spacer, lower shaker screen, and the upper shaker inserted in the track between an upper retainer and a lower retainer of the track in a clamped position of the multi-screen configuration; and installing the screen assembly in a single screen configuration, comprising:

when the screen assembly is in the multi-screen configuration, removing the upper shaker screen and the small spacer from the track;

after removing the upper shaker screen and the small spacer from the track, inserting in the track above the lower shaker screen and adjacent the actuator a large spacer having a second spacer dimension larger than the first spacer dimension of the small spacer and selected to correspond to the single screen configuration; and actuating the actuator to provide a clamping force to clamp the large spacer and the first shaker screen between the upper retainer and the lower retainer of the track in a clamped position of the single screen configuration.

17. The method of claim 16, further comprising:

when in the clamped position of the multi-screen configuration, de-actuating the actuator to position the screen assembly from the clamped position to an unclamped position where the actuator is de-actuated to release the clamping force on the lower shaker screen, the upper shaker screen and the small spacer; and when in the unclamped position of the multi-screen configuration, slidably removing the upper shaker screen and the small spacer from the track.

18. The method of claim 17, wherein the installing the screen assembly in the multi-screen configuration further comprises inserting a screen seal between the small spacer and the lower shaker screen.

19. The method of claim 16, wherein installing the screen assembly in the multi-screen configuration further comprises:

after removing the large spacer when the screen assembly is in the single screen configuration, inserting the small spacer and the upper shaker screen into the track; and actuating the actuator to provide a clamping force to clamp the first shaker screen, the upper shaker screen and the small spacer between the upper retainer and the lower retainer of the track in a clamped position of the multi-screen configuration.

20. The method of claim 16, wherein installing the screen assembly in the single screen configuration further comprises securing the large spacer in the track with a spacer retainer assembly, and wherein the spacer retainer assembly comprises a spacer keyway in the large spacer and a spacer retainer configured for the spacer keyway and disposed in the track, and wherein the spacer keyway includes a socket configured to slidably receive the spacer retainer in the internal socket to position the large spacer in a locked position.

* * * * *